United States Patent [19]

Carlson, Jr.

[11] 3,951,568

[45] Apr. 20, 1976

[54] PUMP CHECK VALVE CONTROL APPARATUS

[75] Inventor: William L. Carlson, Jr., St. Cloud, Minn.

[73] Assignee: General Signal Corporation, Rochester, N.Y.

[22] Filed: Jan. 29, 1974

[21] Appl. No.: 437,552

[52] U.S. Cl. ..... 417/27; 417/29; 417/40; 137/488

[51] Int. Cl.[2] ..... F04B 49/04; F16K 31/12

[58] Field of Search ..... 137/488, 487; 417/20, 417/26, 27, 29, 40, 43

[56] References Cited

UNITED STATES PATENTS

| | | | |
|---|---|---|---|
| 2,240,607 | 5/1941 | Buck | 417/28 |
| 2,339,957 | 1/1944 | Smith | 417/29 |
| 2,619,110 | 11/1952 | Griswold | 137/488 |
| 2,661,023 | 12/1953 | Griswold | 137/488 |
| 2,732,804 | 1/1956 | Sadler et al. | 417/26 |
| 3,092,305 | 6/1963 | Bresnoff | 417/6 |
| 3,814,541 | 6/1974 | Dent et al. | 417/20 |

*Primary Examiner*—William L. Freeh
*Assistant Examiner*—G. P. LaPointe
*Attorney, Agent, or Firm*—Jeffrey S. Mednick

[57] ABSTRACT

A pump check valve control apparatus includes a pump for delivering a fluid to a system. A valve between the pump and the system controls the delivery of the fluid to the system. A valve actuator, signalled by an actuator control, begins to open the valve when the pressure on the pump side of the valve substantially equals the system pressure. During the opening cycle of the valve, a substantially constant pressure is maintained in the system. The actuator control closes the valve so that flow through the valve ceases when the pressure differential across the valve is substantially zero.

38 Claims, 11 Drawing Figures

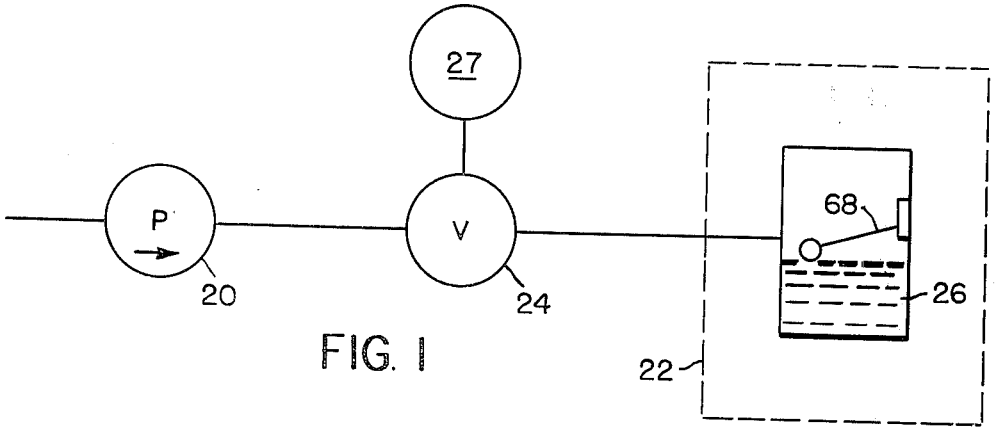
FIG. 1
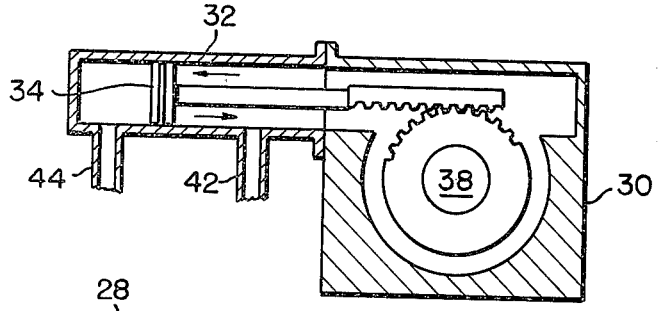
FIG. 3
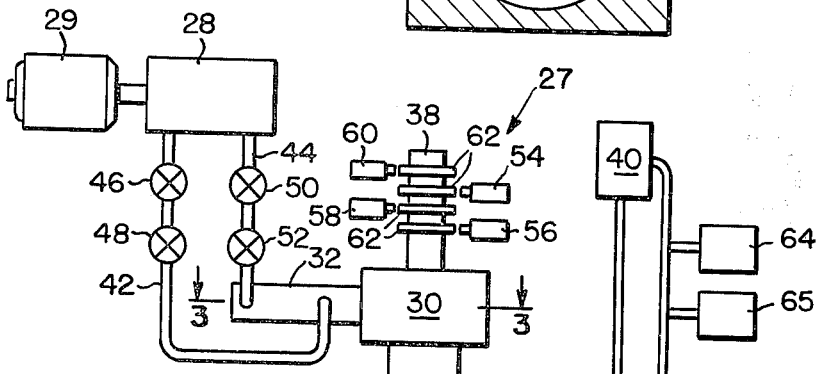
FIG. 2
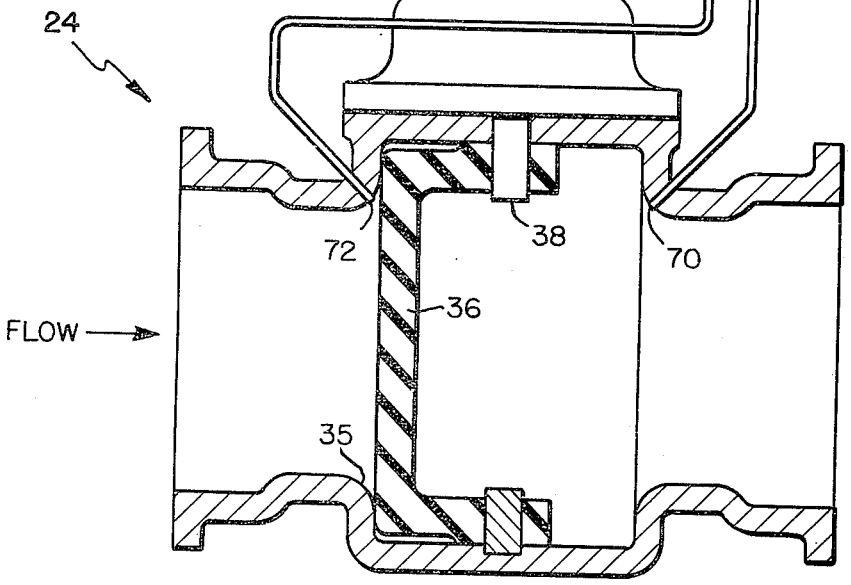

PUMP CHECK VALVE CONTROL APPARATUS

BACKGROUND OF THE INVENTION

While the invention is subject to a wide range of applications, it is especially suited for services such as water, sewage, and other liquids, as well as slurries which cause leakage or plugging in a simple check valve and will be particularly described in that connection.

It is a common practice to provide a pump check valve in a pumping system in order to prevent backflow to the pump and assure positive flow control. The valve is located between the pump and the system which receives the pump fluid. By keeping the valve closed during start up, the pump need not work against system pressure or backflow. This pump check valve can also reduce the possibility of water hammer and surge throughout the system. Water hammer and surge occur because in preventing backflow, the valve must be kept closed while the pump is brought up to a discharge pressure which is higher than the pressure in the system downstream from the valve. When the valve is then opened, the high discharge pressure contacts the lower system pressure and can cause water hammer and surge. Pump check valaves generally use controls to open and close in relation to the pump output. Up to now, pump check valves have not consistently eliminated water hammer and surge.

The prior art use of pump check valves can be described as follows: A decrease in system pressure or liquid level causes a switch to start the pump motor, and the discharge pressure of the pump begins to rise. After the pump discharge pressure reaches system pressure, another pressure switch energizes the valve actuator and the valve begins to open at a preset speed. As the pump output increases, the valve continues towards its fully open position. Finally, the pump reaches 100% capacity at the same time that the valve is fully open. This not only prevents pressure build-up at the valve, but also prevents any backflow to the pump.

The prior art closing cycle commences when a pressure or level requirement in the system is satisfied and a signal is transmitted to the pump check valve which begins its closing cycle at a preset speed. When the valve reaches a predetermined partially closed position, the pump is turned off. The valve continues to close as the pump slows down. Finally, the valve is supposed to close just as the forward flow from the pump stops.

The prior art system described above depends on an external and remote device, not correlated with the operating characteristics of the pump or the valve, for controlling the actuation of the system. Prior art devices have not been ale to consistently eliminate the problem of water hammer and surging in piping systems. In piping systems of large diameters and/or systems of high pressure, the elimination of water hammer and surging becomes extremely important as this phenomena can actually tear apart a valve or a pipe and can therefore prove to be very costly.

In addition, prior pump check valve systems require very lage actuators to develop the high torque necessary for rotating the valve against a high downstream pressure.

It is an object of the present invention to provide a method and apparatus that eliminates pressure surging and water hammer.

It is a further object of the present invention to provide a method and apparatus that maintains constant pressure in the system during the entire opening cycle of the valve.

It is a further object of the present invention to provide a method and apparatus that delivers fluid to the system when the pressure differential across the pump check valve is substantially zero.

It is a further object of the present invention to provide a pump check valve control apparatus whose valve port is fully open just as the pump reaches full discharge pressure.

It is a further object of the present invention to provide a pump check valve control apparatus whose valve port is fully closed just as the discharge pressure of the pump is substantially equal to the pressure of the system.

It is a further object of the present invention to provide a pump check valve control apparatus whose actuator requires a low torque to open.

SUMMARY OF THE INVENTION

In accordance with the present invention, a pump check valve control apparatus is disclosed. It includes a pump for delivering a fluid to a system with a valve between the pump and the system for controlling delivery of the fluid to the system. A valve actuator, signalled by an actuator control, begins to open a valve port when the pressure on the pump side of the valve substantially equals the system pressure. Another aspect of the present invention is that a substantially constant pressure is maintained in the system during the opening cycle of the valve. In accordance with an additional feature of the present invention, the control closes the valve port so that flow through the valve ceases just as the pressure diffferential across the valve is substantially zero.

For a better understanding of the present invention, together with other and further objects thereof, reference is made to the following description taken in connection with the accompanying drawings, while its scope will be pointed out in the appended claims.

BRIEF DESCRIPTION OF THE DRAWINGS

FIG. 1 is a schematic view illustrating a pump check valve control application in accordance with the present invention;

FIG. 2 is a schematic view, partly in cross-section, illustrating a pump check valve control apparatus in accordance with the present invention;

FIG. 3 is an enlarged cross-sectional view of the valve actuator shown in FIG. 2;

DESCRIPTION OF THE PREFERRED EMBODIMENT

Figure 4:
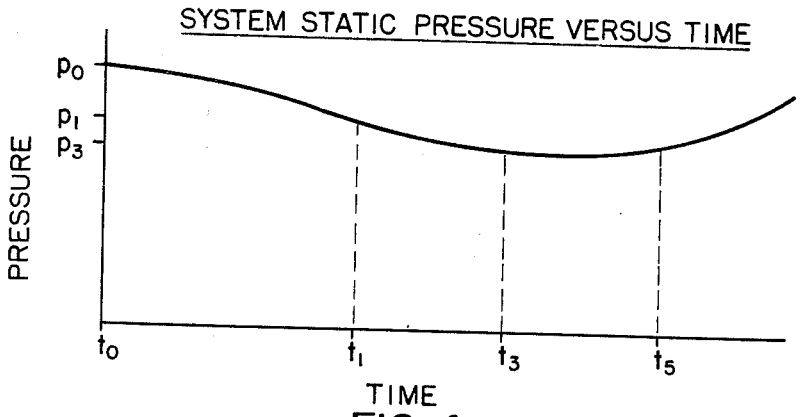
FIG. 4 is a plot of system static pressure versus time.

Referring to FIG. 1, there is shown a schematic view of pump check valve control application which includes a pump 20 for delivering a fluid to a system 22. A pump check valve 24, such as, for example, a Series 100 eccentric valve manufactured by DeZurik, a unit of General Signal Corporation, in Sartell, Minn., is located between the pump 20 and the system 22 and controls the delivery of fluid to the system. When the pressure in system 22 decreases to a predetermined amount, such as, for example, 60 P.S.I. in a municipal water system, pump 20 is signalled to begin pumping fluid toward system 22. Pressure builds up on the pump side of valve 24 and when the pressure differential across valve 24 approaches zero, valve 24 is opened. Pressure continues to build up on the pump side of valve 24, causing fluid to flow to system 22.

Referring to FIG. 2, the pump check valve control apparatus of the present invention is clearly shown. The pressure differential across valve 24 is sensed by two pressure taps 70 and 72, located on the system and pump sides, respectively, of valve 24. A pressure differential switch 40, such as, for example, Model No. P606 sold by Honeywell, Inc., produces a signal when the pressure differential across valve 24 approaches zero. This signal is sent to start an electric motor 29 which runs a high pressure hydraulic pump 28, such as, for example, Model No. 25VIZA sold by the Vickers Division of the Sperry Rand Corporation. The combination of pump 28 and electric motor 29 is considered an electrohydraulic device. Hydraulic pump 28 then delivers hydraulic fluid to a valve actuator 30 through a cylinder 32, as shown in FIG. 3. Fluid, delivered to cylinder 32 through hydraulic line 42, causes piston 34 to move. This results in a counter-clockwise rotation of valve stem 38, and, therefore, valve plug 36, which causes valve 24 to start to open.

As will be described more fully hereinbelow, an important aspect of the present invention resides in the fact that valve 24 is opened at a speed which will maintain a constant system pressure while the valve is opening.

In order to control the speed with which valve 34 opens, speed controls 46 and 48 are provided in hydraulic line 42. Similarly, speed controls 50 and 52 are provided in hydraulic line 44 to control the speed with which valve 24 closes. These speed controls may comprise solenoid actuated variable restrictors, such as, for example, Model EFL-355 flow controls distributed by Air Hydraulic Systems, Inc. By restricting the flow of hydraulic fluid through lines 42 or 44, the speed with which piston 34 travels, and thus valve plug 36 rotates in opening or in closing, may be controlled. In the present invention, each of the speed controls is preset, so that when it is actuated, fluid is permitted to pass at a given rate. This controls the speed of rotation of plug 36.

In the apparatus illustrated in FIG. 2, motor 29 is activated by the differential pressure switch 40 when the pressure differential across valve 24 approaches zero. The speed of operation is simultaneously controlled by speed control 46. Speed control 48 is activated by position operated switch 54, to decrease the speed of rotation of plug 36, for the reasons set forth hereinbelow. Position operated switch 54, as well as switches 56, 58, and 60, is considered part of the valve actuator control 27, and is operated by engaging one of several contacts operated by a cam surface 62 carried on valve stem 38. Placement of the cams 62 with respect to stem 38 determines the time at which a speed control is activated. Speed control 50 is activated simultaneously with pressure operated switch 65 to set the initial closing speed of valve 24 when the pressure in system 22 reaches an upper control point. Speed control 52 is activated by position operated switch 58 to increase the speed of rotation of plug 36, as described hereinbelow. An electrical schematic of a typical circuit used in the control apparatus as described above is illustrated in FIG. 12. Therefore, hydraulic fluid flows through line 42 at a flow rate determined by either speed control 46 or speed control 48 to open valve 24. It flows through line 44 at a flow rate determined by either speed control 50 or speed control 52 to close valve 24.

The following chart is presented to aid in understanding of the present invention:

- $t_0$ — time when system static pressure is dropping in response to system demand
- $t_1$ — time when system static pressure has reached the control point
- $t_2$ — time when valve plug 36 begins to rotate in a counter-clockwise direction
- $t_3$ — time when valve 24 just begins to open
- $t_4$ — time when speed of rotation of valve plug 36 decreases
- $t_5$ — time when pump discharge pressure is first fully developed
- $t_6$ — time when upper control point is reached and valve 24 begins to close
- $t_7$ — time when speed of rotation of valve plug 36 increases and the pump 20 is disconnected
- $t_8$ — time when valve is completely closed and the pump 28 is disconnected This chart, together with the apparatus shown in FIGS. 1, 2, and 3, will be helpful in understanding the operating cycle of the present invention, a detailed explanation of which now follows.

Assume that at time $t_1$, a demand on the system has caused the static pressure of system 22 to fall to a lower control point as measured at pressure tap 70. When pressure switch 64 senses this control point, it closes and starts the pump 20. As the pump gains speed, its discharge pressure rises and the pressure differential across valve 24 dimishes. At time $t_2$, the pressure differential across valve 24 is at a predetermined but adjustable value, close to zero. At this time, electric motor 29 is energized by the differential pressure switch 40 and hydraulic pump 28 begins to pump fluid to actuator 30. This causes actuator 30 to quickly rotate valve stem 38 and plug 36 to begin opening valve 24. Pressure switch 40 is wired to energize speed control 46 to control the rate of flow of hydraulic fluid to cylinder 32. Valve plug 36 must rotate a small distance before the port area actually begins to open and thereby allow fluid to begin flowing at time $t_3$.

The time difference between time $t_3$ and time $t_2$ is very small and can be changed by adjusting the amount of differential pressure to which pressure switch 40 responds. Switch 40 is set so that valve port 35 begins to open just as the differential pressure across valve 24 reaches zero. This prevents surging and water hammer as the flow begins at time $t_3$.

In actual practice, pressure switch 40 is set to energize motor 29 at time $t_2$ when a pressure differential across valve 24 equals approximately zero. During the small time span, $t_3$ minus $t_2$, the pressure differential across valve 24 can change only a small amount. Therefore, even though valve port 35 actually opens with a higher pressure on the pump side than the system side, the differential pressure is so small that the system does not notice an appreciable effect. Theoretically, however, valve plug 36 should begin to rotate before the differential pressure across valve 24 equals zero. Therefore, the description of the invention applies a theoretical analysis in order to provide a better understanding of the invention.

Actuator 30 continues to rotate valve plug 36 at a preset, but adjustable, speed. This speed is fixed such that the increasing pressure drop across valve 24 is equal to the increase in the discharge pressure of pump 20. The result is an essentially constant pressure in system 22 as measured at pressure tap 70. During the opening cycle, the speed in which valve plug 36 rotates must be changed in order to keep a constant pressure in system 22. Therefore, at some time $t_4$, one of the cams 62 on the valve stem 38 is set to actuate a position operated switch 54. Switch 54 disconnects control 46 and activates control 48 to cause actuator 30 to operate at a slower but constant speed which fully opens the valve 24 at time $t_5$. Then, an open position limit switch 56 engages a contact 62 and shuts off electric motor 29 of hydraulic pump 28 and speed control 48. Time $t_5$ is adjusted such that valve 24 is completely open just as pump 20 reaches full discharge and thus insures minimum surging.

System 22 is then in a stable operating condition wherein the pressure of the system reflects a system load and in general slowly rises as the pump discharge exceeds system demand and restores pressure.

The closing sequence begins at a time $t_6$ when the static pressure of the system reaches an upper control point, as measured at pressure tap 70. Pressure operated switch 65 is wired to start electric motor 29 of hydraulic pump 28 and activate speed control 50 when the upper control point is reached. Valve actuator 30 starts rotating valve plug 36 at a fixed speed, as determined by speed control 50, which is generally slow.

At time $t_7$, a cam 62 operates switch 58 to disengage speed control 50, shut off pump 20, and actuate speed control 52 to operate actuator 30 at a fixed higher speed.

The closing speed of valve actuator 30 is adjusted so that valve 24 completely closes just as the discharge pressure of pump 20 equals the higher pressure of system 22. Again, surging and water hammer are minimized. Finally at time $t_8$, pump 20 has coasted to a stop and a close position limit switch 60 has shut off electric motor 27 of hydraulic pump 28.

The above described embodiment relies on the sensing of system static pressure to initiate the opening and closing sequence. However, the present invention also contemplates a second embodiment where a remote fluid level control 68 initiates the opening and closing sequences. In this second embodiment the control may be located to sense fluid level in a container, such as tank 26. When the fluid level of the tank drops to a predetermined point, control 68 signals pump 20 to pump fluid toward system 22. As in the first embodiment, valve 24 does not permit flow until the differential pressure across valve 24 equals zero. The closing sequence of the second embodiment is similar to that of the first embodiment except that the closing is initiated when the level in tank 26 rises to a predetermined point.

In order to more fully understand the invention, a derivation of the complete cycle follows and is explained in a detailed, qualitative manner. It can be seen from FIG. 4, a plot of system static pressure versus time, that the system static pressure at any time, such at $t_0$, as measured at pressure tap 70, is normally decaying when valve 24 is closed. The rate of decay is a function of the load on the system, the system size, and the type of the system.

The static head, just downstream from valve plug 36, decays along the curve from $p_0$ to $p_1$ during the time $t_1$ minus $t_0$. This time span is significant in that some interval is required to determine the slope of the pressure curve. When the curve has a negative slope from $t_0$ to $t_1$, a condition is approaching when fluid is needed in the system. Alternatively, a positive slope indicates that the system is approaching a condition where the desired capacity of the system if reached.

At time $t_1$, the system pressure has decayed to pressure $p_1$. This is sensed by pressure tap 70 and, since $p_1$ is the lower control point, pressure switch 64 closes to start pump 20.

Figure 5:
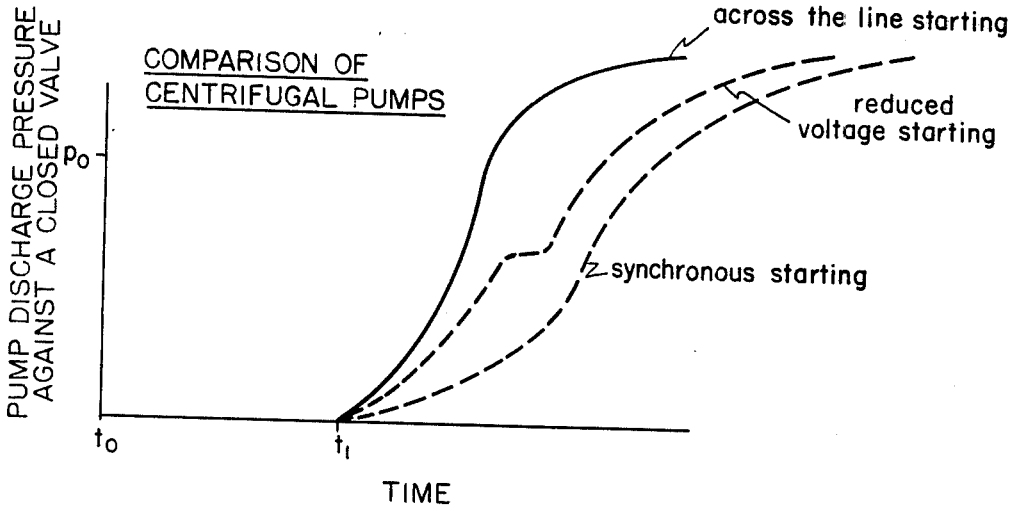
FIG. 5 is a plot showing a comparison of centrifugal pumps.

The electric motors and pumps contemplated by this disclosure may have power ratings from approximately 100 horsepower to over 1,000 horsepower. In addition, motors have a wide variety of starting characteristics. This variation is shown in FIG. 5, a typical pressure versus time plot showing a comparison of centrifugal pumps starting up against a closed valve. The three curves illustrated are for pumps using electric motors with "across the line" starting, "reduced voltage" starting, and "synchronous" starting. The significance of the starter curves is not in their precise shape, but rather in their general S-shapes and the variations in time required for the different pumps to obtain full operating speed. It call be seen from the curves that an across the line starting pump is preferred because it comes up to speed quickly. However, any type of starter can be easily accommodated. In fact, one of the inherent features of the present invention is its improved operating with even false starts or slow starts during low supply voltage conditions. This feature is realized because actuator 30 moves in response to a signal from differential pressure switch 40. The signal from differential pressure switch 40 does not occur until the pressure differential across valve 24 approaches zero, no matter how fast or slow pump 20 builds up pressure. Therefore, valve 24 never begins to open until the discharge pressure of the pump reaches a predetermined value with respect to the system pressure.

Figure 6:
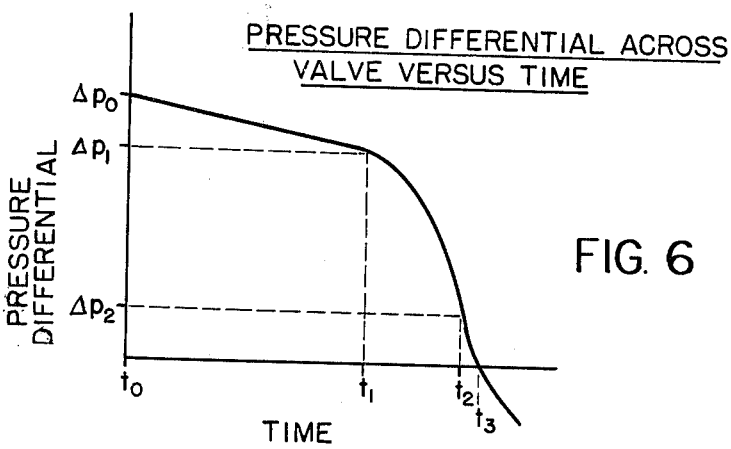
FIG. 6 is a plot of pressure differential across a valve versus time.

Differential pressure switch 40 is set to close at some low but positive value of pressure. The pressure differential across valve 24 is arbitrarily called positive when the pressure on the pump side is lower than that on the system side. Note that in FIG. 6, a plot of pressure differential across valve 24 versus time, the differential pressure becomes zero and then negative at time $t_3$. To fully understand this point, refer to FIG. 5, which shows the pump pressure increasing with respect to time and beginning the increase at time $t_1$. At time $t_3$, the pump discharge pressure is equal to the pressure in system 22. At that point, the differential pressure across valve 24 is equal to zero as seen in FIG. 6. At a later time, the discharge pressure of pump 20 is even higher than the system pressure, and the differential becomes negative.

Referring again to FIG. 6, note that at time $t_2$ there is a low but positive pressure differential $\Delta p_2$ as explained previously. Since a slight time lapse is required between the time $t_2$, when the valve plug 36 begins to rotate, and time $t_3$, when valve port 35 begins to open and starts to permit flow, differential pressure switch 40 is adjusted to close at $\Delta p_2$. Switch 40 activates speed control 46 and a high pressure hydraulic pump 28 which pumps fluid to actuator 30 and thus turns valve plug 36. After a small time lapse, $t_3$ minus $t_2$, valve plug 36 begins to permit flow. One aspect of the invention is that valve plug 36 just begins to permit flow when the pressure drop across valve 24 is equal to zero. This opening occurs at $t_3$ (see FIG. 6). It can be accomplished by adjusting differential pressure switch 40. The time difference, $t_3$ minus $t_2$, is thus adjusted to equal the time required for valve plug 36 to move to a position where port 35 begins to open and flow starts at $t_3$. The ability to thus adjust the time difference permits the use of several types of centrifugal pumps irrespective of the starting characteristics as seen in FIG. 5.

Since the valve begins to open at low differential pressure values, ideally zero, the torque required by the actuator is substantially reduced. As an example, a 14 inch eccentric plug valve required only 1/50 of the torque needed under previous operating conditions. Although the actuator must provide enough torque to overcome the dynamic torque generated by the flow through the valve, the invention still permits the use of a much smaller and thus cheaper actuator.

The present invention also includes the capability of controlling the speed of valve operation in such a way as to avoid surging and water hammer as the valve continues to open. The combination of parts can be adjusted to reduce the possibility of surging and water hammer to an absolute minimum during both start-up, shutdown, and even with wide variation in the system's load, pumps, and temperature of process water.

Referring again to FIG. 4, which demonstrates in a qualitative way the action of the system during the start-up of pump 20, consider time $t_5$ as the point when valve 24 becomes fully open. If, during the time period $t_5$ minus $t_3$, the system static pressure is kept constant, there can be no surging or water hammer. In order for the static pressure of system 22 to remain constant over a time space, $t_5$ minus $t_3$, the opening speed of the valve coupled with the starting speed of pump 20 and the pressure rise must be controlled.

Figure 7:
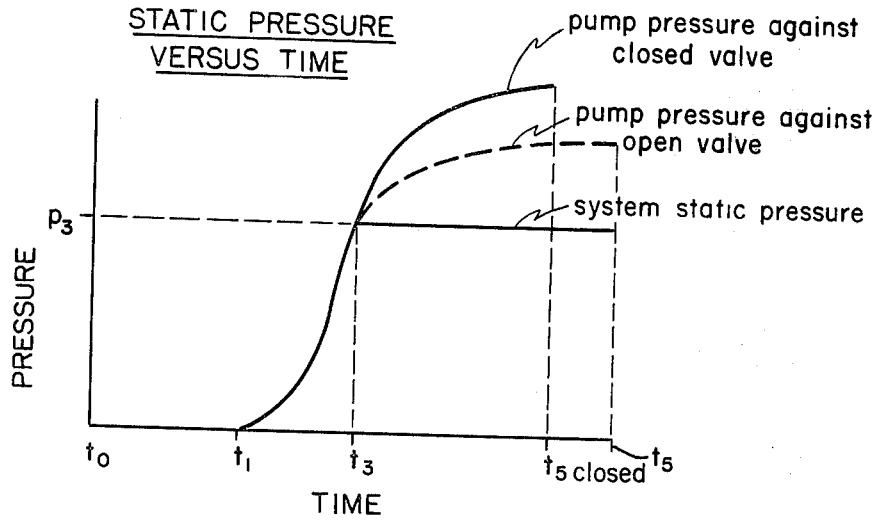
FIG. 7 is a plot of static pressure versus time.

Referring to FIG. 7, a plot of static pressure versus time, note the relationship between the pressure rise of a pump starting against a shut valve, the pressure rise of a pump starting against an open valve, and the static pressure of system 22. The pressure rise of the pump against an opening valve as the flow builds up to a maximum at time $t_5$, is depicted by the dashed curve from time $t_3$ to time $t_5$. At any time between time $t_3$ to time $t_5$, the pressure differential across the valve is the difference between the dashed curve and the solid line representing the system static pressure. Thus, to keep the static pressure constant from time $t_3$ to time $t_5$, it is necessary to control the speed of the valve opening such that at any time $t_x$, between time $t_3$ and time $t_5$, the flow results in a pressure drop across the valve equal to the difference between the pump discharge pressure and the static pressure of the system. By keeping the static pressure constant, the objective of eliminating surging and water hammer can be accomplished.

Figure 8:
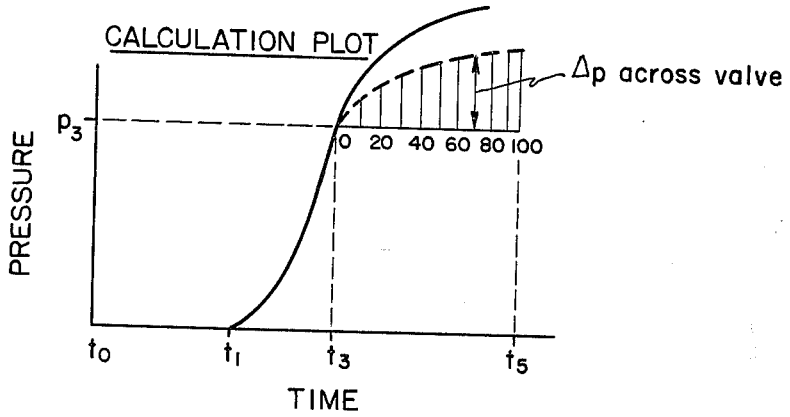
FIG. 8 is a calculation plot.

FIG. 8 is identical to FIG. 7 with a portion of the time axis divided by ten points each representing 10 percent of the time from time $t_3$ to time $t_5$. At each 10 percent of time, a pressure differential at that time can be obtained assuming that the dashed curve is precisely known. Although this curve is not ordinarily known in detail, its general shape is as drawn and is always parabolic in nature. A feature of the present invention is that by knowing the general shape of the curve, the precise curve is not required. To understand this feature, consider the following: Assume that a pressure differential value, expressed as a percent of the value of $\Delta p$ at time $t_5$ which is ordinarily known for each of the ten points is taken from the curve in FIG. 8. Then the proper percentage values are substituted in the following flow rate equation:

$$Q = c\,A\sqrt{2g\,\Delta p}$$

Where:

$Q$ = volume rate of flow
$c$ = coefficient of discharge
$A$ = area of flow
$g$ = gravitational acceleration
$\Delta p$ = pressure differential across valve A percent of maximum flow rate is then calculated for each of the ten pressure differential values found in FIG. 8.

Figure 9:
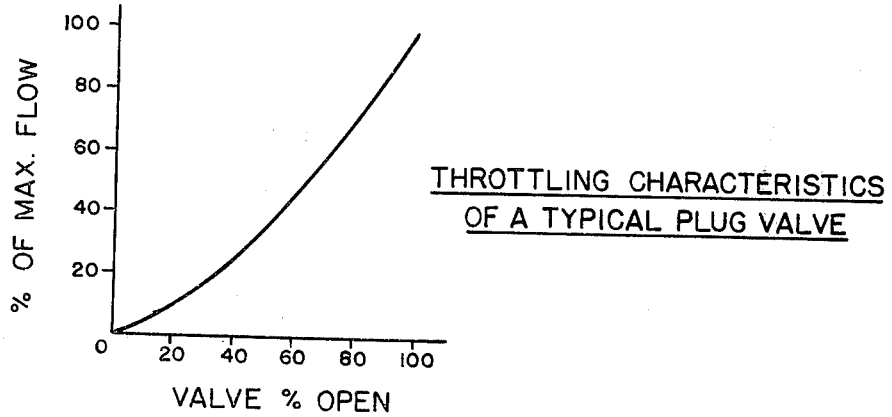
FIG. 9 is a a plot of the throttling characteristics of a typical plug valve.

Next, refer to a readily obtainable plot of the throttling characteristics of the valve being used, such as the plot for DeZurik Series 100 eccentric plug values in sizes 4 inch to 54 inch as shown in FIG. 8. Since a percent value for the maximum flow for each 10 percent of time has been calculated as explained above, the percentage that the valve is open can be determined for each of the ten values by using FIG. 9.

Figure 10:
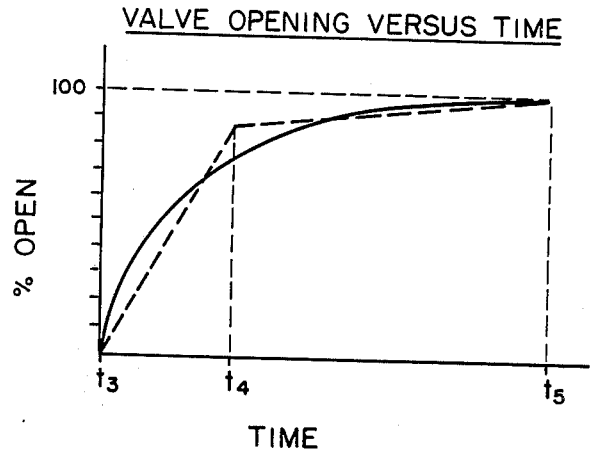
FIG. 10 is a plot of percent of valve open versus time.

A plot is then made of the percentage open versus time, resulting in a curve similar to the solid curve in FIG. 10. The slope, at any point on the curve of FIG. 10, represents the ratio of percent open to change in time and differentiates to the speed of opening. Note the rapid rise at the beginning of the curve followed by a gradual rise as the valve approaches fully open. This curve represents the speed with which valve 24 should be opened to keep the system pressure constant. It might be possible to use an actuator that would open the valve according to the curve, but this would be relatively expensive due to the shape of the curve. Moreover, it is possible to approximate the curve with two straight lines, each of which represents a constant speed. This has been shown as two dashed lines in FIG. 10. Using this straight line approximation, an error of less than approximately one pound per square inch may be obtained. This error is usually inconsequential in the type of system described.

By turning pump 20 on as previously described, and adjusting a speed control 46, the first straight dashed line can be traced. Then at $t_4$, a position operated switch 54 activates a speed control 48 to make the actuator slow down to a preset speed during the remaining portion of the opening cycle of the valve. This is traced by the upper dashed line and follows the plot as seen in FIG. 10.

In opening a pump check control valve, the present invention permits approximation of the ideal curve, as seen in FIG. 10, with two speed controls and an adjustment for altering the position at which the speed changes.

When the pressure in system 22 has risen to the upper control point and pump 20 is to be shut off, there are two main considerations to be taken into account. First, valve 24 must close such that the water will not turn pump 20 in a reverse direction. This phenomenon is known as pump "wind up." Second, the closing cycle must again avoid surging and water hammer.

Figure 11:
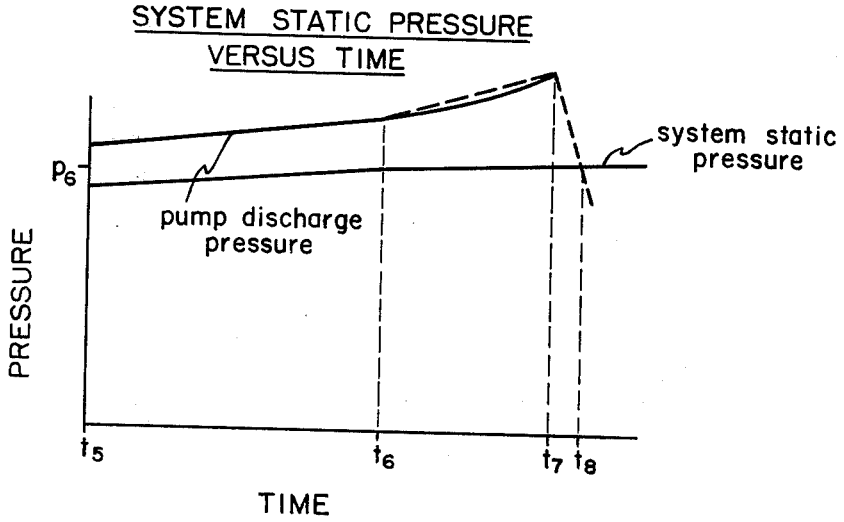
FIG. 11 is a plot of system static pressure versus time.

Referring to FIG. 11, there is shown a plot of the pressure in various parts of the system during the period when the pump is being shutdown. At time $t_6$, the system static pressure has risen to pressure $p_6$. This is sensed by pressure tap 70, and, since $p_6$ is the upper control point, pressure switch 65 closes to operate electric motor 29. The motor 29 can rotate either clockwise or counter-clockwise. In this way, the motor is capable of turning pump 28 so as to deliver hydraulic fluid to either side of cylinder 32. Changing the direction of flow from pump 28 can also be accomplished by directional solenoid valves (not shown). During the closing cycle hydraulic fluid from pump 28 is directed to actuator 30 so that valve plug 36 rotates in a clockwise direction and begins to close valve port 35. The pressure switch 65 also activates speed control 50 which is generally set to slowly close valve 14.

Then at time $t_7$, the valve stem 38 has rotated to a position where position operated switch 60 engages cam 62 and is closed. Switch 60 is wired to activate speed control 52, disengage speed control 50, and shut off pump 20. The actuator 30 quickly rotates valve plug 36 to close valve port 35.

At time $t_8$, the valve 24 has just closed as the differential pressure across valve 24 equals zero. At that time, a position operated switch 60 disengages motor 29 and valve plug 36 no longer rotates.

Referring to FIG. 11, a plot of system static pressure versus time, note that after time $t_6$, the curve of pump discharge pressure initially starts to slowly increase. Then the curve begins to rise more sharply as valve port 35 continues to close. Since the valve port 35 is closing, the pump discharge pressure rises until the pump 20 is turned off at $t_7$.

For economical reasons, as explained in the operation of the opening cycle, a two speed actuator is used to close valve 24 according to a curve of pump discharge pressure.

The slow speed with which valve plug 36 is set to rotate during the time span of $t_7$ minus $t_6$ is determined experimentally. The pumping system, as seen in FIG. 1, is actually set up in the field or with simulated field conditions. Then speed control 50 is set so that at time $t_7$ the pump discharge pressure does not reach an extremely high value (approximately 5 to 15 percent above system pressure), the valve is approximately 90% closed, and there are no excessive surges, shocks, or water hammer in the system. These latter factors cannot be determined during the manufacture of the pump check valve because of factors, such as, the distance of the pump to the valve and the amount of load.

Referring to FIG. 11, at time $t_7$, the pump discharge pressure drops very quickly. This quick pressure drop is caused by pump 20 no longer pumping and therefore quickly slowing down due to its loaded condition. At time $t_8$, the pump discharge pressure equals the system static pressure. By closing valve 24 when the differential pressure across it equals zero, surge or water hammer is prevented and backflow from the system is prevented from reaching pump 20. Thus, speed control 52 is adjusted so that valve plug 36 rotates fast enough to completely stop flow just as the differential pressure across valve 24 equals zero. This is represented by a dashed line from $t_7$ to $t_8$ on FIG. 11.

One skilled in the art will realize that there has been disclosed a pump check valve control apparatus that substantially eliminates surging and water hammer, eliminates pump backspin, has the entire control function assumed by the valve and its accessories, and requires much smaller actuators.

While there has been described what is at present considered a preferred embodiment of the invention, it will be obvious to those skilled in the art that various changes and modifications may be made therein without departing from the invention, and it is, therefore, aimed in the appended claims to cover all such changes and modifications as followed in the true spirit and scope of the invention.

What is claimed is:

1. A pump check valve control apparatus, comprising:

means for delivering a fluid to a system;

valve means between said delivering means and said system for controlling the delivery of the fluid to the system;

a valve actuator for positioning said valve means; and actuator control means for moving said valve actuator at a time when the pressure upstream of said valve means is slightly less than the system pressure whereby said valve means starts to open when the differential pressure across said valve means is substantially zero.

2. A pump check valve control apparatus, comprising:

means including a pump for delivering a fluid to a system;

valve means between said delivering means and said system for controlling the delivery of the fluid to the system;

a valve actuator for positioning said valve means;

means sensing differential pressure across said valve means;

and actuator control means responsive to said sensing means to operate said valve actuator at different speeds and for maintaining an increase in pressure drop across said valve means approximately equal to the discharge pressure of said pump during the entire opening cycle of said valve means whereby a substantially constant pressure is maintained in system.

3. The pump check valve control apparatus defined in claim 2, wherein said delivering means further includes a first pressure switch means for starting said pump when the static pressure in the system drops to a first predetermined value.

4. The pump check valve control apparatus defined in claim 2, wherein said delivering means further includes a first level control switch means for starting said pump when the level of fluid in a portion of the system drops to a first predetermined point.

5. The pump check valve control apparatus defined in claim 3, wherein said valve means includes an eccentric valve.

6. The pump check valve control apparatus defined in claim 2, wherein said actuator control means includes electro-hydraulic means for turning said valve actuator.

7. The pump check valve control apparatus defined in claim 6, wherein said actuator control means includes a differential pressure switch means for energizing said electro-hydraulic means so that the fluid is initially delivered to the system when the pressure differential across the valve means is substantially zero.

8. The pump check valve control apparatus defined in claim 7, wherein said differential pressure switch means causes said electro-hydraulic means to begin to open said valve actuator at a first preset speed in order for the increase in pressure drop across said valve means to be substantially equal to an increase in the discharge pressure of said pump.

9. The pump check valve control apparatus defined in claim 8, wherein said actuator control means includes a first position operated switch means for energizing a speed control means at a desired position of said valve actuator so that said valve means is opened at a second preset speed less than said first preset speed in order for the increasing pressure drop across said valve means to be substantially equal to the increasing discharge pressure of said pump.

10. The pump check valve control apparatus defined in claim 9, wherein an open position limit switch shuts off said electro-hydraulic means when said valve means is fully open and said pump reaches full discharge pressure.

11. The pump check valve control apparatus defined in claim 10, wherein said actuator control means includes a second pressure switch means for causing said valve means to begin to close at a third preset speed when a second predetermined pressure in the system is reached.

12. The pump check valve control apparatus defined in claim 11, wherein said actuator control means includes a second position operated switch means for stopping said pump and for actuating a speed control to cause said valve means to close at a fourth preset speed greater than said third preset speed so that said valve means closes when the discharge pressure of said pump is substantially equal to the pressure of the system.

13. The pump check valve control apparatus defined in claim 12, wherein said actuator control means includes a closed position limit switch means to stop said valve actuator when said valve means is closed.

14. The pump check valve control apparatus defined in claim 13, wherein said actuator control means includes adjustable cam means on said valve actuator for actuating said first and second position operated switch means and said closed position limit switch.

15. The pump check valve control apparatus defined in claim 2, wherein said actuator control means includes a second pressure switch means for causing said valve means to begin to close at a third preset speed when a second predetermined pressure in the system is reached.

16. The pump check valve control apparatus defined in claim 15, wherein said actuator control means includes a second positon operated switch means for stopping said pump and for actuating a speed control means to cause said valve means to close at a fourth preset speed greater than said third preset speed so that said valve means closes when the discharge pressure of said pump of substantially equal to the pressure of the system.

17. The pump check valve control apparatus defined in claim 16, wherein said actuator control means includes a closed position limit switch means to stop said valve actuator when said valve means is closed.

18. A pump check valve control apparatus, comprising:

means including a pump for delivering a fluid to a system;

valve means between said delivering means and said system for controlling the delivery of the fluid to the system;

sensing means for sensing a condition of a fluid in said system;

actuator control means for closing said valve means upon the increase of said sensed condition to a predetermined value;

first speed control means connected to said actuator control means for beginning to close said valve means at a first preset speed whereby the discharge pressure of said pump is limited to approximately fifteen percent above the pressure in said sytem;

positon operated switch means connected to said actuator control means for stopping said pump and energizing a second speed control means; and said second speed control means for causing said valve means to close at a second preset speed so that said valve means shuts off just as the discharge pressure of said pump is substantially equal to the pressure of the system.

19. The pump check valve control apparatus defined in claim 18, wherein said actuator control means includes a level control switch means for causing said valve means to begin to close at a first preset speed when the level of fluid in a portion of the system rises to a predetermined point.

20. The pump check valve control apparatus defined in claim 18, wherein said actuator control means includes a pressure switch means for causing said valve means to begin to close at a first preset speed when a predetermined pressure in the system is reached.

21. The pump check valve control apparatus defined in claim 18, wherein said actuator control means includes a closed position limit switch means for stopping said valve actuator when said valve means is closed.

22. The pump check valve control apparatus defined in claim 21, wherein said actuator control means includes electro-hydraulic means for turning said valve actuator.

23. The pump check valve control apparatus defined in claim 22, wherein said actuator control means includes adjustable cam means on said valve actuator for actuating said position operated switch means and said closed position limit switch means.

24. A method of controlling flow comprising the steps of:

sensing a condition of a fluid in a system located downstream of a valve;

signalling a pump upstream of said valve to pump a fluid to the system upon a drop of the sensed condition to a first predetermined value;

sensing the pressure on the upstream and downstream sides of the valve;

beginning to actuate the valve just as the sensed pressure indicates a slightly lower pressure upstream of the valve; and continuing to open the valve so that fluid begins to flow across the valve when the differential pressure across said valve is substantially zero.

25. The method as set forth in claim 24, wherein said sensed condition is the static pressure.

26. The method as set forth in claim 24, wherein said sensed condition is the level of the fluid.

27. A method of controlling flow comprising the steps of:

sensing a condition of a fluid in a system located downstream of a valve;

signalling a pump upstream of said valve to pump a fluid to the system upon a drop of the sensed condition to a predetermined value;

sensing the differential pressure across the valve;

opening the valve to a fully open position at different speeds, in response to the differential pressure, and maintaining an increase in pressure drop across said valve during the opening of the valve approximately equal to discharge pressure of said pump whereby a substantially constant pressure is maintained in the system.

28. The method as set forth in claim 27, wherein said sensed condition is the static pressure.

29. The method as set forth in claim 27, wherein said sensed condition is the level of the fluid.

30. A method of controlling flow comprising the steps of:

sensing a condition of a lfuid in a system located downstream of a valve;

signalling a pump upstream of said valve to pump a fluid to the system upon a drop of the sensed condition to a predetermined value;

sensing the pressure on the upstream and downstream sides of the valve;

beginning to actuate the valve just as the sensed pressure indicates a slightly lower pressure upstream of the valve;

continuing to open the valve so that fluid begins to flow across the valve when the differential pressure across said valve is substantially zero;

opening the valve at two different speeds to a fully open position whereby a substantially constant pressure is maintained in the system.

31. The metod as set forth in claim 30, wherein said valve begins to open at a first preset speed.

32. The method as set forth in claim 31, wherein said valve fully opens at a second preset speed less than said first preset speed.

33. A method of controlling flow comprising the steps of:

sensing a condition of a fluid in a system located downstream of a valve;

signalling a pump upstream of said valve to pump a fluid to the system upon a drop of the sensed condition to a predetermined value;

sensing the pressure on the upstream and downstream sides of the valve;

beginning to actuate the valve just as the sensed pressure indicates a slightly lower pressure upstream of the valve;

continuing to open the valve so that liquid begins to flow across the valve when the differential pressure across said valve is substantially zero;

opening the valve at two different speeds to a fully open position whereby a substantially constant pressure is maintained in the system;

signalling said valve to begin closing upon an increase of said sensed condition to a second predetermined value;

partially closing said valve at a speed which prohibits the discharge pressure of said pump to exceed approximately fifteen percent above the pressure in said system;

stopping said pump and continuing to close said valve at a second speed whereby said valve completely shuts off just as the discharge pressure of said pump substantially equals the discharge pressure of said system.

34. A method of controlling flow comprising the steps of:

delivering a fluid with a pump to a system;

controlling the delivery of the fluid to the system with a velve;

sensing a condition of the fluid in the system located downstream of said valve;

signalling said valve to begin closing upon an increase of said sensed condition to a predetermined value;

partially closing said valve at a speed which prohibits the discharge pressure of said pump to exceed approximately fifteen percent above the pressure in said system;

stopping said pump located upstream of said valve while continuing to close said valve at a second speed whereby said valve completely shuts off just as the discharge pressure of the pump substantially equals the discharge pressure of said system.

35. The method as set forth in claim 34, wherein said valve begins to close at a first preset speed.

36. The method as set forth in claim 35, wherein said valve continues to close at a second preset speed greater than said first present speed.

37. The method as set forth in claim 36, wherein said sensed condition is the static pressure.

38. The method as set forth in claim 37, wherein said sensed condition is the level of the fluid.

* * * * *

UNITED STATES PATENT OFFICE

CERTIFICATE OF CORRECTION

PATENT NO. : 3,951,568

DATED : April 20, 1976

INVENTOR(S) : William L. Carlson, Jr.

It is certified that error appears in the above-identified patent and that said Letters Patent are hereby corrected as shown below:

In Column 1, line 27, please substitute -- valves -- for "valaves."

In Column 1, line 58, please substitute -- able -- for "ale."

In Column 1, line 66, please substitute -- large -- for "lage."

In Column 2, line 40, please substitute -- differential -- for "diffferential."

In Column 3, line 47, please substitute -- 24 -- for "34."

In Column 6, line 22, please substitute -- is -- for "if."

In Column 6, lines 38 and 41, please place quotation marks around "S-shapes" and "across the line," respectfully.

In Column 8, line 33, please substitute -- valves -- for "values."

In Claim 2, final line, please insert -- the -- before "system."

In Claim 16, line 8, please substitute -- is -- for "of."

In Claim 30, line 3, please substitute -- fluid -- for "lfuid."

UNITED STATES PATENT OFFICE
CERTIFICATE OF CORRECTION

PATENT NO. : 3,951,568
DATED : April 20, 1976
INVENTOR(S) : William L. Carlson, Jr.

It is certified that error appears in the above-identified patent and that said Letters Patent are hereby corrected as shown below:

In Claim 33, line 13, please substitute -- fluid -- for "liquid."

In Claim 34, line 5, please substitute -- valve -- for "velve."

Figure 12:
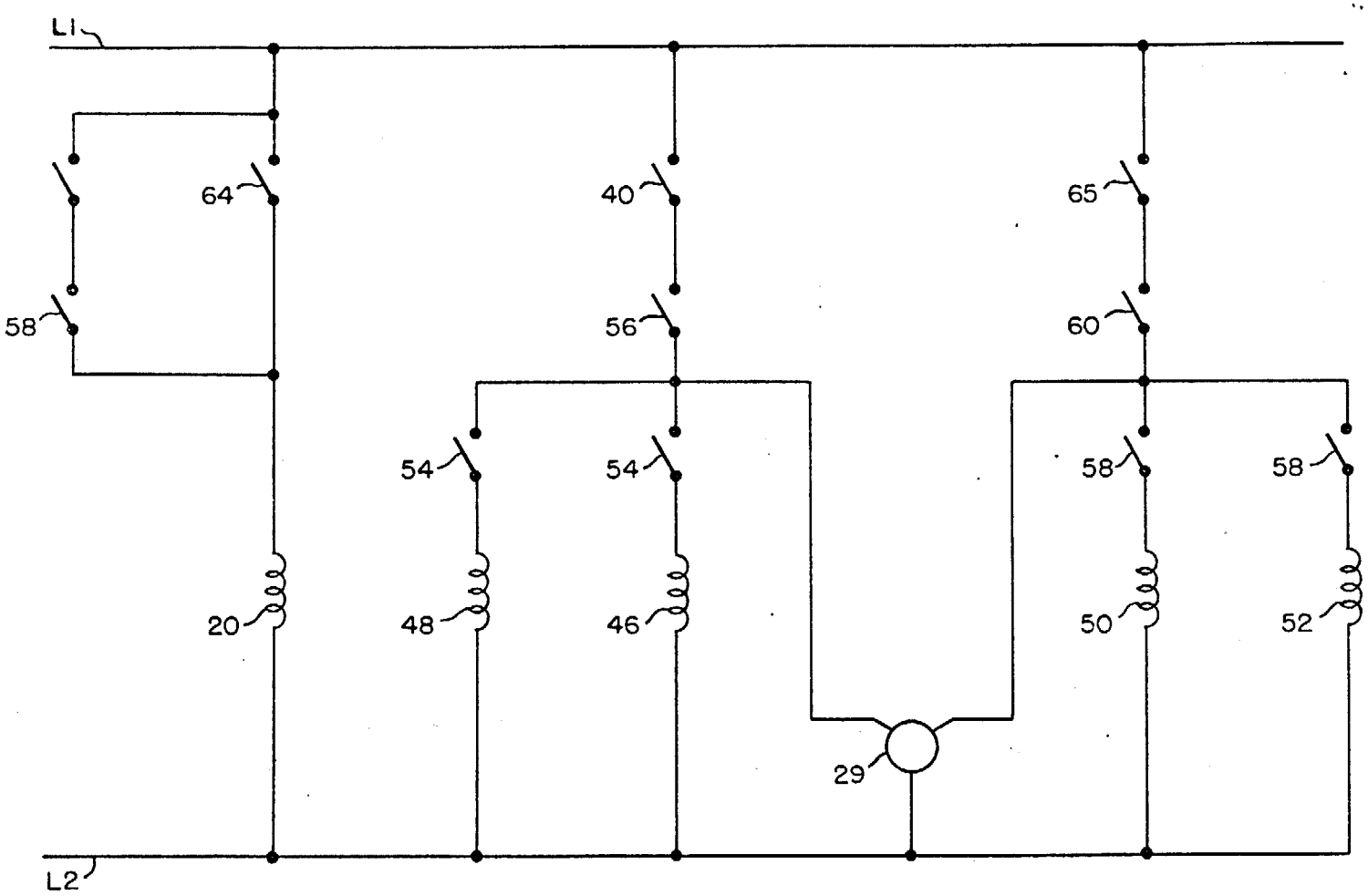
FIG. 12 is an electrical schematic of a control apparatus.

Please add Figure 12 to the drawings.

Signed and Sealed this

Thirtieth Day of November 1976

[SEAL]

*Attest:*

RUTH C. MASON
*Attesting Officer*

C. MARSHALL DANN
*Commissioner of Patents and Trademarks*